US008910783B2

(12) United States Patent
Liu

(10) Patent No.: US 8,910,783 B2
(45) Date of Patent: Dec. 16, 2014

(54) ELECTRONIC CIGARETTE CASE

(71) Applicant: Qiuming Liu, Guangdong (CN)

(72) Inventor: Qiuming Liu, Guangdong (CN)

(73) Assignee: Kimree Hi-Tech Inc, Road Town, Tortola (VG)

( * ) Notice: Subject to any disclaimer, the term of this patent is extended or adjusted under 35 U.S.C. 154(b) by 0 days.

(21) Appl. No.: 13/861,141

(22) Filed: Apr. 11, 2013

(65) Prior Publication Data

US 2014/0216961 A1 Aug. 7, 2014

(30) Foreign Application Priority Data

Feb. 1, 2013 (CA) ..... 2013 2 0056681

(51) Int. Cl.
*B65D 85/10* (2006.01)
*A24F 15/12* (2006.01)
*A24F 15/00* (2006.01)

(52) U.S. Cl.
CPC ..... *A24F 15/12* (2013.01); *B65D 85/10* (2013.01); *A24F 15/00* (2013.01)
USPC ..... 206/266; 220/829; 220/830

(58) Field of Classification Search
CPC ..... A24F 15/00; A24F 15/12; A45C 13/007; B65D 85/10
USPC ..... 206/242, 265, 266; 220/246, 810, 820, 220/823, 825, 827, 829, 830, 845
See application file for complete search history.

(56) References Cited

U.S. PATENT DOCUMENTS

| | | | | | |
|---|---|---|---|---|---|
| 374,584 | A | * | 12/1887 | Cook | 206/266 |
| 540,440 | A | * | 6/1895 | Heissenberger | 206/266 |
| 744,074 | A | * | 11/1903 | Hiering | 206/266 |
| 799,844 | A | * | 9/1905 | Fuller | 206/266 |
| 2,327,120 | A | * | 8/1943 | McCoon | 206/266 |
| 3,001,227 | A | * | 9/1961 | Long et al. | 220/830 |
| 4,460,105 | A | * | 7/1984 | Cox | 220/830 |

* cited by examiner

*Primary Examiner* — Luan K Bui
(74) *Attorney, Agent, or Firm* — Tim Tingkang Xia, Esq.; Morris, Manning & Martin, LLP

(57) ABSTRACT

An electronic cigarette case includes a box body, a box cover hinged to the box body and an opening and closing mechanism. The opening and closing mechanism includes a spring piece built in the box body and an arc-shaped bulge formed on the box cover. The arc-shaped bulge clamped between the spring piece and inner wall of the box body and slidingly contact with the spring piece. When the box cover rotates a first predetermined angle relative to the box body, the spring piece drives the bulge to slide relative to the spring piece until the box cover is fully open. When the box cover rotates a second predetermined angle relative to the box body, the spring piece drives the arc-shaped bulge to slide relative to the spring piece until the box cover is fully closed. Thus, it is convenient to open or close the electronic cigarette case which has a simplified structure.

7 Claims, 5 Drawing Sheets

ELECTRONIC CIGARETTE CASE

CROSS-REFERENCE TO RELATED APPLICATIONS

This non-provisional application claims priority under 35 U.S.C. §119(a) on Patent Application No. 201320056681.4, filed in P.R. China on Feb. 1, 2013, the entire contents of which are hereby incorporated by reference.

FIELD OF THE INVENTION

The present invention relates to electronic cigarette domain, more particularly, to a kind of electronic cigarette case.

BACKGROUND OF THE INVENTION

Nowadays, two methods are adopted to open flip-open covers of existing electronic cigarette cases. One method is manually opening, that is, opening a flip-open cover by a hand without the use of any flick mechanism. The other method is using torsional spring mechanisms, that is, opening a flip-open cover by torque force generated by a torsional spring mounted on a rotation axle of the electronic cigarette case cover. In the two above-mentioned methods, a drawback of manually opening is embodied in failing to open and close a flip-open cover automatically using a flick mechanism, which may cause the opening operation to be inconvenient. Adopting the torsional spring mechanism can provide force for opening the flip-open cover, however, the torsional spring mechanism has complicated structure and irregular appearance. This method needs to add a press button or push button, and, the appearance of an electronic cigarette case using the torsional spring mechanism may be affected by the torsional spring exposed out of a surface of the case.

SUMMARY OF THE INVENTION

Aiming at aforementioned drawbacks in the prior art including complicated structure and bad user experience, the objective of the present invention is to provide a kind of switching mechanism with the purpose of opening and closing a flip-open cover semi-automatically, which makes a simplified structure and a convenient operation of electronic cigarette case possible.

The technical proposal of the present invention is implemented by providing a kind of electronic cigarette case which comprises a box body, a box cover hinged to the box body, and an opening and closing mechanism, the opening and closing mechanism including a spring piece built in the box body and an arc-shaped bulge formed on the box cover, the arc-shaped bulge clamped between the spring piece and an inner wall of the box body and slidingly contacting with the spring piece; wherein when the box cover rotates a first predetermined angle relative to the box body, the spring piece pushes the arc-shaped bulge, which makes the arc-shaped bulge slidingly contacting relative to the spring piece until the box cover is fully open; and when the box cover rotates a second predetermined angle relative to the box body, the spring piece pushes the arc-shaped bulge, which makes the arc-shaped bulge slidingly contacting relative to the spring piece until the box cover is fully closed.

In the electronic cigarette case of the present invention, the opening and closing mechanism further comprises a spring built in the box body horizontally, and two ends of the spring are fixed to the box body and the spring piece respectively.

In the electronic cigarette case of the present invention, the spring piece comprises a bending part, a part of the bending part protruding to form a bridge-shaped fixing position, and an end of the spring passes through the bending part and secured to said spring piece.

In the electronic cigarette case of the present invention, the spring piece further comprises a connection part connected to the bending part, the spring is perpendicular to the connection part.

In the electronic cigarette case of the present invention, the spring piece is secured to interior of the box body via at least one screw(s).

In the electronic cigarette case of the present invention, the electronic cigarette case further comprises needle shaft, a first hinge joint part is formed on the box cover, a second hinge joint part is formed on the box body and is inserted by the first hinge joint part, a first through-hole is defined in the first hinge joint part, a second through-hole being coaxial to the first through-hole is defined in the second hinge joint part, and the needle shaft inserts into the first through-hole and the second through-hole.

In the electronic cigarette case of the present invention, the cooperation among the needle shaft, the first through-hole and the second through-hole is implemented via gaps among the needle shaft, the first through-hole and the second through-hole.

In the electronic cigarette case of the present invention, a V-shaped bulge is formed on the second hinge joint part, a V-shaped recess formed the first hinge joint part has a bigger opening angle than the V-shaped bulge, and the V-shaped bulge is embedded into the V-shaped recess.

In the electronic cigarette case of the present invention, a fillet chamfer is formed on the lateral of the V-shaped recess.

When implementing the present invention, the following advantageous effects can be achieved: according to the opening and closing mechanism, which includes a spring, a spring piece, and a bulge cooperating with the spring piece and sliding relative to the spring piece, and is built in the electronic cigarette case; when the box cover rotates a predetermined angle, the bulge is pushed and slides relative to the spring piece until the box cover is open or closed completely, and thus the box cover is open or closed semi-automatically. The structure of electronic cigarette case makes box cover to be opened or closed automatically when the box cover merely rotates a certain angle, and the opening and closing mechanism has a simplified structure, which doesn't cause negative effects to the appearance of the electronic cigarette case.

BRIEF DESCRIPTION OF THE DRAWINGS

The present invention and its technical proposal will be described briefly with reference to accompanying drawings in the following. In the figures.

DETAILED DESCRIPTION OF THE PREFERRED EMBODIMENT

Figure 1:
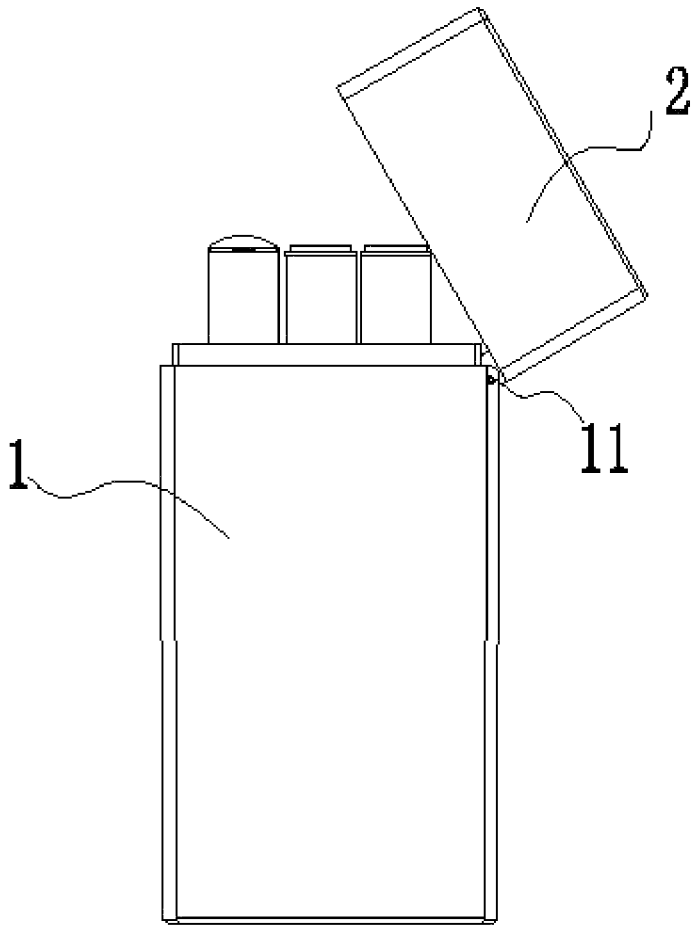
FIG. 1 is a schematic view of the whole structure in accordance with a preferred embodiment of the present invention.
Figure 2:
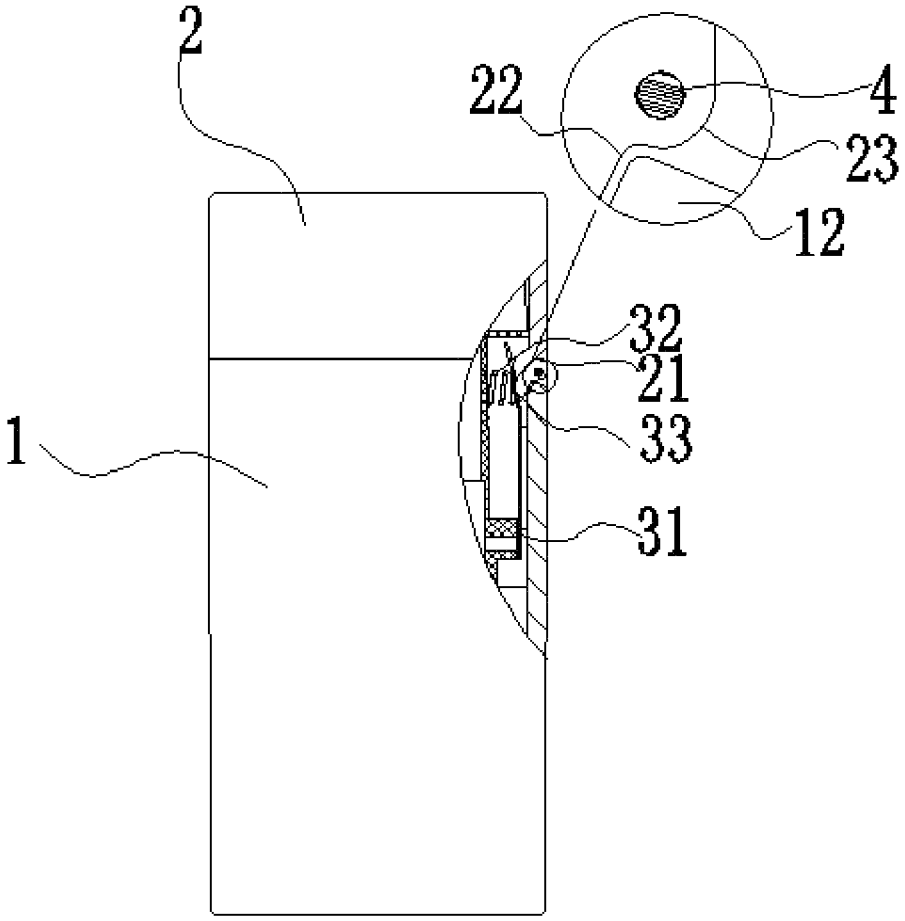
FIG. 2 is a partial cutway view of a fully closed status of said electronic cigarette case in FIG. 1 shown in FIG. 1.
Figure 3:
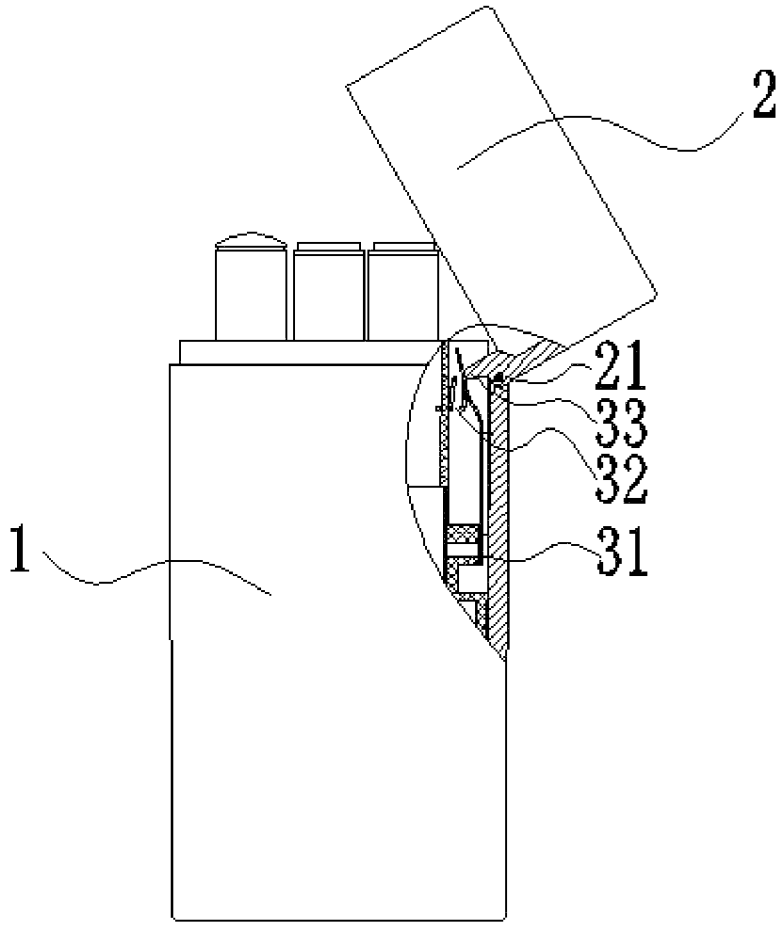
FIG. 3 is a partial cutway view of a semi-opened status of said electronic cigarette case shown in FIG. 1.
Figure 4:
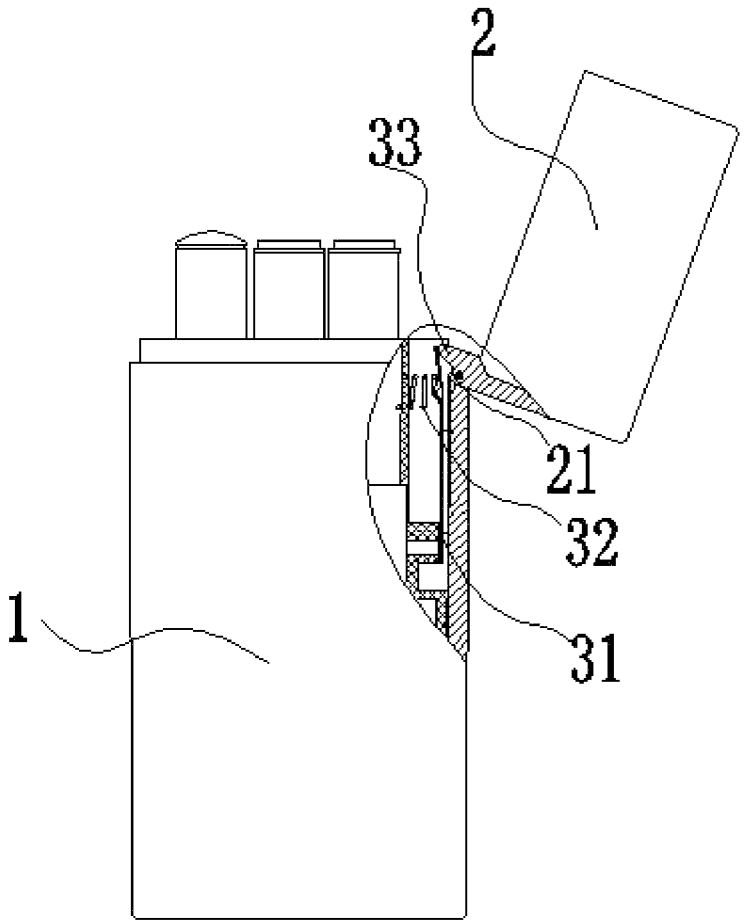
FIG. 4 is a partial cutway view of a fully opened status of said electronic cigarette case shown in FIG. 1.
Figure 5:
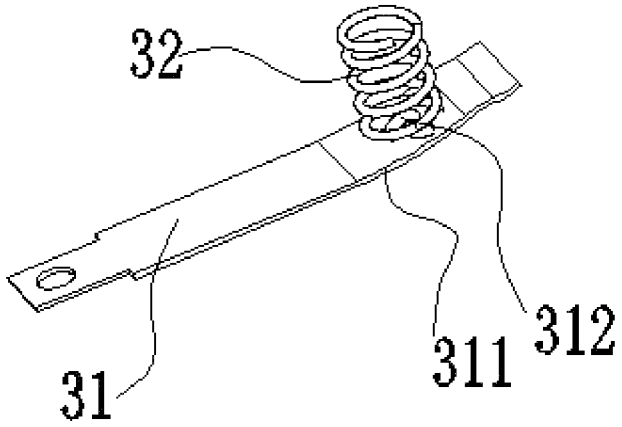
FIG. 5 is a structurally schematic view of the spring piece of said electronic cigarette case shown in FIG. 1.

As shown in FIG. 1, FIG. 2, FIG. 3 and FIG. 4, the electronic cigarette case in accordance with the present invention comprises a box body 1, a box cover 2 and an opening and closing mechanism, the box cover 2 is hinged to the box body 1, the opening and closing mechanism includes a spring piece 31 built in the box body 1 and an arc-shaped bulge 33 formed on the box cover 2, the arc-shaped bulge 33 is clamped between the spring piece 31 and inner wall of the box body 1 and slidingly contact with the spring piece 31;

When the box cover 2 rotates a first predetermined angle relative to the box body 1, the spring piece 31 pushes the arc-shaped bulge 33, which makes the arc-shaped bulge 33 slidingly contacting relative to the spring piece 31 until the box cover 2 is fully open.

When the box cover 2 rotates a second predetermined angle relative to the box body 1, the spring piece 31 pushes the arc-shaped bulge 33, which makes the arc-shaped bulge 33 slidingly contacting relative to the spring piece 31 until the box cover 2 is fully closed.

The opening and closing mechanism further comprises a spring 32 built in the box body 1 horizontally, and two ends of the spring 32 are fixed to said box body 1 and the spring piece 31 respectively.

Particularly, elastic force is generated by the spring 32. The spring piece 31 drives the arc-shaped bulge 33 to slide relative to spring piece 31 until the box cover 2 is fully open or fully closed by the elastic force.

Understandably, the rotation direction of the first preset angle is opposite to that of the second preset angle.

Duo to above-mentioned structure in the electronic cigarette case, the box cover 2 opens or closes automatically relative to the box body 1 when the box cover 2 rotates a predetermined angle, which makes the electronic cigarette case easy to use.

Particularly, the spring piece 31 has a bending part 311, a part of the bending part 311 protruding to form a bridge-shaped fixing position 312, and an end of spring 32 passes through fixing position 312 and secured to spring piece 31. That is, firstly, a bridge-shaped fixing position 312 is formed via punching press process on the surface of the spring piece 31. The bridge-shaped structure of the bridge-shaped fixing position 312 can be an arc-shaped structure or an V-shaped structure. Both two ends of the fixing position 312 connects to the spring piece 31, and the lateral of the fixing position 312 disconnects from the spring piece 31. Secondly, one end of spring is bent and inserted into the fixing position 312, and the spring 32 is secured to the spring piece 31 via pressing the portion of the spring 32 which has passed through the fixing position 312. Understandably, the form that the spring 32 fixed to the spring piece 31 should not be limited to above-mentioned methods, and can also be achieved via welding processing as well.

The bending part 311 provides the arc-shaped bulge 33 with orientation guidance and changes the direction of the force toward the arc-shaped bulge 33 via the inclination part of the bending part 311 simultaneously, which makes arm of force to be generated easily relative to jointed shaft, the opening and closing operations of the box cover 2 are facilitated.

The spring piece 31 further comprises a connection part connected to the bending part 311, and the spring 32 is perpendicular to said connection part.

The spring 31 is secured to interior of the box body 1 by at least one screw(s). Particularly, the connection part defines a aperture, the interior of the box body 1 defines a threaded hole corresponding to the aperture, and the spring piece 31 is secured to the interior of the box body 1 via inserting a screw into the aperture and the threaded hole.

Similarly, other methods, such as an insertion method, can be adopted to enable spring piece 31 secured to the interior of the box body 1.

The electronic cigarette case further comprises a needle shaft 4, a first hinge joint part 21 formed on box cover 2, a second hinge joint part 11 formed on the box body 1 and inserted by the first hinge joint part 21, a first through-hole is defined in the first hinge joint part 21, a second through-hole being coaxial to the first through-hole is defined in the second hinged joint part 11, and the needle shaft 4 is inserted into the first through-hole and the second through-hole.

A V-shaped bulge 12 is formed on second hinge joint part 11, a V-shaped recess 22 is formed on the first hinge joint part 21 and has a bigger opening angle than the V-shaped bulge 12, and the V-shaped bulge 12 is embedded into the V-shaped recess 22. A fillet chamfer 23 is formed on the outer lateral of the V-shaped recess 22 and cooperates with the V-shaped bulge 12 to make the box cover 2 open easily when the box cover 2 is fully closed or make the box cover 2 to be closed easily when the box cover 2 is fully opened by manual operation. The rotation between the box cover 2 and the box body 1 will become more flexible when the V-shaped recess 22, the V-shaped bulge 12 and the fillet chamfer 23 are in use. Meanwhile, a lateral wall of the V-shaped bulge 12 constrains the sphere of activity of the box cover 2 and determines extreme position when the box cover 2 is fully open relative to the box body 1. Similarly and understandably, the bulge 12 and the recess 22 are not limited to V-shape, the bulge 12 may be arc-shaped bulge, the recess 22 may be arc-shaped recess, and the combination of the fillet chamfer 23 and the arc-shaped recess 22 forms a wave-shaped appearance. This structure facilitates opening and closing of the box cover 2.

Detail of cover opening process and cover closing process is as follows:

When the box cover 2 is closed, the force point between the arc-shaped bulge 33 and the spring piece 31 is lower than the needle shaft 4(that is, the moment of force is generated toward closing direction relative to the needle shaft 4 by the acting force between the spring piece 31 and the arc-shaped bulge 33), the spring piece 31 presses the arc-shaped bulge 33 and makes the arc-shaped bulge 33 clamped between the spring piece 31 and the inner wall of the box cover 2 with the help of the spring 32. When the opening operation orients the box cover 2, the box cover 2 is rotated a predetermined angle by applied force, the force point between the arc-shaped bulge 33 and the spring piece 31 is higher than the needle shaft 4 (that is, the moment of force is generated and oriented opening direction relative to the needle shaft 4 by the acting force between the spring piece 31 and the arc-shaped bulge 33), the spring 32 provides the spring piece 31 with elastic force, which drives the arc-shaped bulge 33 to slide relative to spring 31 and makes box cover 2 to be open without applied force.

The box cover 2 is located at extreme position when it is fully open, the spring piece 31 receives the acting force from the spring 31 and provides the arc-shaped bulge 33 with a pressure, which makes the arc-shaped bulge 33 to be held and prevents the box cover 2 from rotating toward cover closing direction.

When the box cover 2 needs to be closed, the box cover 2 is rotated a second predetermined angle toward closing direction via manual operation, meanwhile, the force point between the arc-shaped bulge 33 and the spring piece 31 is lower than the needle shaft 4 (that is, the moment of force toward closing direction is generated relative to the needle shaft 4 by applied force between the spring 31 and the arc-shaped bulge 33), the elastic force applied on the spring piece 31 makes the arc-shaped bulge 33 to slide relative to the spring piece 31, and the box cover 2 is closed without the help of applied force accordingly.

Understandably, the dimension of the first predetermined angle and the second predetermined angle relates to the shape of the arc-shaped bulge 33 and the bending of the spring piece 31, it means that the first predetermined angle and the second predetermined angle can be determined by the specified shape of the arc-shaped bulge 33 and the bending of the spring piece 31 during manufacturing process.

The embodiments of the present invention are described according to the accompanying figures in the following, however, the present invention is not limited to the aforementioned embodiments, those embodiments is only considered as some demonstration without limitation to the present invention, the one skilled in the art can make lots of modalities under the inspiration of the present invention without breaking away from the principle and the protecting scope of the claims, and these modalities are within the protecting scope of the present invention.

The invention claimed is:

1. An electronic cigarette case, comprising a box body (1), a box cover (2) hinged to the box body (1), and an opening and closing mechanism, the opening and closing mechanism including a spring piece (31) built in the box body (1) and an arc-shaped bulge (33) formed on the box cover (2), the arc-shaped bulge (33) clamped between the spring piece (31) and an inner wall of the box body (1) and slidingly contacting with the spring piece (31);

wherein when the box cover (2) rotates a first predetermined angle relative to said box body (1), the spring piece (31) pushes the arc-shaped bulge (33), which makes the arc-shaped bulge (33) slidingly contacting relative to the spring piece (31) until the box cover (2) is fully open;

when the box cover (2) rotates a second predetermined angle relative to the box body (1), the spring piece (31) pushes the arc-shaped bulge (33), which makes the arc-shaped bulge (33) slidingly contacting relative to the spring piece (31) until the box cover (2) is fully closed;

said opening and closing mechanism further comprises a spring (32) built in the box body (1) horizontally, and two ends of the spring (32) are fixed to the box body (1) and the spring piece (31) respectively; and the spring piece (31) comprises a bending part (311), a part of said bending part (311) protrudes to form a bridge-shaped fixing position (312), and an end of the spring (32) passes through the bending part (311) and is secured to the spring piece (31).

2. The electronic cigarette case of claim 1, characterized in that the spring piece (31) further comprises a connection part connected to the bending part (311), the spring (32) is perpendicular to said connection part.

3. The electronic cigarette case of claim 2, characterized in that the spring piece (31) is secured to interior of the box body (1) via at least one screw(s).

4. The electronic cigarette case of claim 3, characterized in that the electronic cigarette case further comprises an needle shaft (4), a first hinge joint part (21) is formed on the box cover (2), a second hinge joint part (11) is formed on said box body (1) and is inserted by the first hinge joint part (21), a first through-hole is defined in the first hinge joint part (21), a second through-hole (21) being coaxial to the first through-hole is defined in the second hinge joint part (11), and the needle shaft (4) inserts into the first through-hole and the second through-hole.

5. The electronic cigarette case of claim 4, characterized in that the cooperation among the needle shaft (4), the first through-hole and the second through-hole is implemented via gaps among the needle shaft (4), the first through-hole and the second through-hole.

6. The electronic cigarette case of claim 4, characterized in that a V-shaped bulge (12) is formed on the second hinge joint part (11), a V-shaped recess (22) formed on the first hinge joint part (21) has a bigger opening angle than the V-shaped bulge (12), and the V-shaped bulge (12) is embedded into the V-shaped recess (22).

7. The electronic cigarette case of claim 6, characterized in that a fillet chamfer (23) is formed on the lateral of the V-shaped recess (22).

* * * * *